US005469910A

United States Patent [19]

Kawa et al.

[11] Patent Number: 5,469,910

[45] Date of Patent: Nov. 28, 1995

[54] PROCESS FOR THE CONTINUOUS CASTING OF METAL, IN PARTICULAR OF STEEL INTO BLOOM AND BILLET CROSS-SECTIONS

[75] Inventors: Franciszek Kawa, Adliswil; Adrian Stilli, Bülach; Adalbert Roehrig, Thalwil, all of Switzerland

[73] Assignee: Concast Standard AG, Zürich, Switzerland

[21] Appl. No.: 304,772

Related U.S. Application Data

[63] Continuation of PCT/EP93/00372, Feb. 17, 1993.

[22] Filed: Sep. 2, 1994

[30] Foreign Application Priority Data

Mar. 5, 1992 [CH] Switzerland ..... 690/92

[51] Int. Cl.[6] ..... B22D 11/00

[52] U.S. Cl. ..... 164/459; 164/418; 164/476

[58] Field of Search ..... 164/459, 476, 164/417, 418, 451–455, 154.7, 413, 472

[56] References Cited

U.S. PATENT DOCUMENTS

| | | | |
|---|---|---|---|
| 4,207,941 | 6/1980 | Shrum | 164/418 |
| 4,249,590 | 2/1981 | William | 164/459 |
| 4,635,702 | 1/1987 | Kolakowski et al. | 164/418 |
| 4,774,995 | 10/1988 | Fastert | 164/418 |
| 5,360,053 | 11/1994 | Kawa et al. | 164/459 |

*Primary Examiner*—P. Austin Bradley
*Assistant Examiner*—I.-H. Lin
*Attorney, Agent, or Firm*—Darby & Darby

[57] ABSTRACT

Molten steel is continuously teemed into a casting passage to establish a bath of molten steel in the passage. The molten steel is partially solidified in the casting passage to form a strand having a plurality of bulges which are uniformly distributed circumferentially of the strand. The strand is continuously withdrawn from the casting passage and the bulges are deformed during strand withdrawal so as to reduce bulge size. The amount of deformation is regulated by varying the bath level as a function of one or more casting parameters.

16 Claims, 2 Drawing Sheets

PROCESS FOR THE CONTINUOUS CASTING OF METAL, IN PARTICULAR OF STEEL INTO BLOOM AND BILLET CROSS-SECTIONS

This application is a continuation of international application PCT/EP93/00372, Feb. 17, 1993.

FIELD OF THE INVENTION

The invention relates to a process for the continuous casting of metal, in particular of steel.

BACKGROUND OF THE INVENTION

Since the beginnings of continuous casting the persons skilled in the art have been occupied with the problem of the formation of air gaps below the bath level between the strand crust and the mould wall. These gaps quite substantially reduce the heat transfer between the mould and the strand crust and cause uneven cooling of the strand crust, which leads to faults in the strand, such as rhomboid shaping, cracks microstructural defects etc. In order to create optimum contact of the strand crust with the mould wall on all sides over the whole length of the mould and thus to obtain the best possible conditions for heat dissipation, many proposals have been made, such as walking beams, the squeezing of coolant into the air gaps, mould cavities with varying conicities etc.

U.S. Pat. No. 4,207,941 discloses moulds for the continuous casting of steel strands with square cross-sections. The cross-section of a mould cavity which is open at both sides is a square with corner chamfers on the inlet side and an irregular dodecagon on the strand outlet side. The taper steadily increases towards the corner chamfers of and near the chamfers is approximately twice as large as in the central region of the mould wall. In casting with such moulds, the strand can become wedged inside the mould, causing breaking off and splitting of the strand. Also, instead of a square, a dodecagon is cast. It is difficult to dimension such moulds for different casting speeds, such as are inevitable in long sequence casting operations with many changes of ladle.

U.S. Pat. No. 4,774,995 discloses a continuous casting mould whose cross-section is larger on the inlet side, in order to receive an immersed pipe, than on the strand outlet side. As the strand passes through the mould, the thickness of the strand decreases, together with the cross-sectional area of the strand, due to deformation upon contact with the wide sides of the mould. The narrow sides of the mould diverge in the direction of travel of the strand in a manner corresponding to the reduction in thickness of the strand, so that the circumference of the strand remains substantially constant. The application of a conventional pouring spout in this casting method causes severe deformation of the strand crust on two sides of the strand, without yielding more homogeneous cooling over the whole circumference of the strand.

SUMMARY OF THE INVENTION

The object of the invention is to overcome the disadvantages cited. In particular, with the casting process according to the invention, improved cooling of the strand crust in the mould, improved strand quality and increased casting output are achieved. Furthermore, the new casting process is intended to optimise stages of operation arising in practice, such as start up, changing of the casting tube, changing of the intermediate vessel, changing of the ladle, termination of casting, breakdowns etc., and thus additionally improve both the strand quality and the service life of the mould.

This object is achieved according to the invention by forming the stand with bulges which are then reshaped or deformed. With the casting process according to the invention it is possible, in the case of bloom and billet cross-sections, to impose cooling which is uniform around the circumference and is measurable within specified limits. Thus crystallisation of the strand crust can be controlled, and the casting output and strand quality can be improved. Unintentional polygonal shaping, surface defects and microstructural faults are avoidable. Due to the continuous adaptation of the strand crust within the mould during the casting operation, the process according to the invention permits improvement in the uniformity of cooling even under varying casting parameters. Defects in the strand and the risk of breaking off and splitting of the strand can be substantially reduced even with markedly varying casting parameters. Furthermore, the service life of the mould can be prolonged.

The degree or amount of deformation or reshaping of a bulge or convexity is determined by the height of the convexity, by the conicity of the convexity, and by the bath level within an upstream portion of the mold. The amount of deformation is generally proportional to the bath level. Instead of being constant, the conicity of the convexity may be degressive, progressive etc. The amount of deformation of the convexity is generally expressed in mm.

If the friction between the strand and the mould is measured the amount of deformation of the convexity can be selected such that the coefficient of friction is optimum for the instaneous casting parameters. Instead of the friction between strand and mould, the withdraw force exerted by the driver a withdrawal unit can be used as a parameter.

The amount of deformation of the convexity can be regulated by continuous measurement of the casting parameters or by mathematical models which take into consideration the steel analysis, the superheating and casting temperatures, the selected casting speed, the type of lubricant and/or the heat flow in the mould.

Deformation can be discontinued by setting the bath level before at or below the lower end of the upstream mould portion.

As the strand passes through a mould of the prior art, the strand cross-section decreases by a small amount due to contraction but deformation does not take place. Due to deformation of the convexity between the bath level and the end of the upstream mould portion in the method of the invention, an additional reduction of the strand cross-section is achieved. The additional reduction can be of the order of 4% to 15% and is preferably between 6% and 10%.

The uncontrolled removal of the strand in the moulds of the prior art has made the lengthening of bloom and billet moulds impractical. The controlled deformation of convexities practical, for the first time, to cool the strand as a function of the casting parameters over a greater mould length, e.g. a length of 500 to 1000 mm. The deformation of the convexity of the strand can take place over a distance of up to 40% of the mould length.

BRIEF DESCRIPTION OF THE DRAWINGS

Embodiments of the invention are explained below with the aid of drawings, in which.

DESCRIPTION OF PREFERRED EMBODIMENTS

Figure 1:
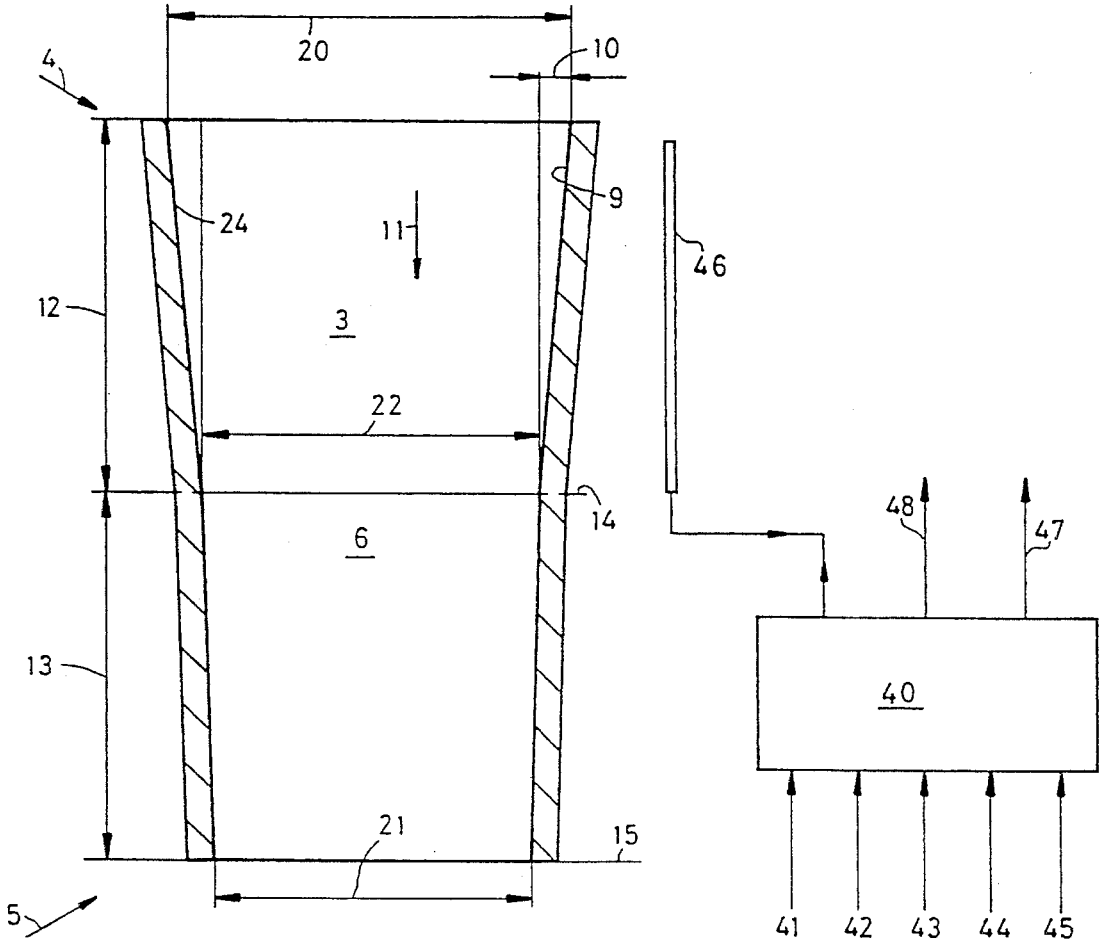
FIG. 1 is a longitudinal section through one embodiment of a tubular mould along the line I—I of FIG. 2.
Figure 2:
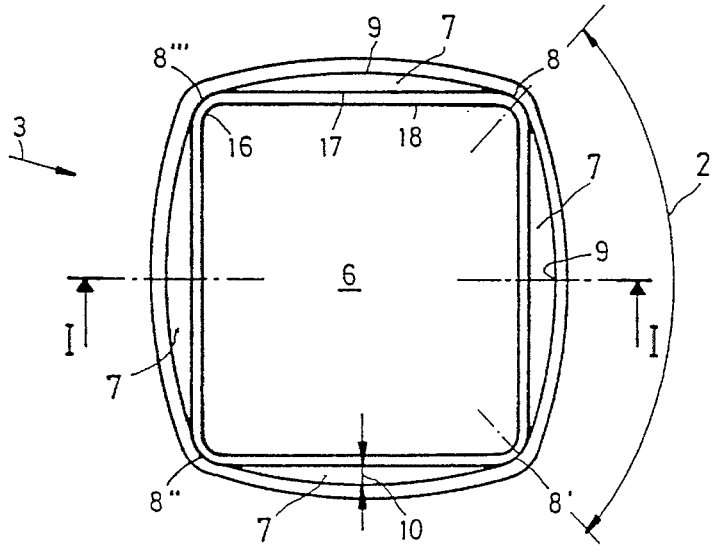
FIG. 2 is a plan view of the mould according to FIG. 1.

FIGS. 1 and 2 show a mould 3 for continuously casting polygonal strand cross-sections, a square cross-section in the present example. An arrow 4 points to an inlet side and an arrow 5 to a strand outlet side of the mould 3. The mould cavity 6 has different geometric forms on the inlet side and the strand outlet side. As can best be seen from FIG. 2, the inlet side 4 of the mould cavity 6 is provided with cross-sectional enlargements in the form of convexities or bulges 9 on the inlet side 4 between the corners 8—8'''. The convexities 9 have a height of curvature 10, which represents the degree of convexity, and the height 10 steadily decreases in the direction of travel of the strand 11 over an upstream portion 12 of the mould cavity 6. The mould cavity 6 has a downstream portion 13 between the planes 14 and 15, and the downstream portion 13 has a square cross-section with chamfers 16, as is known in the prior art.

A circumference line 17 shows the mould cavity cross-section in the plane 14 and a circumference line 18 the mould cavity cross-section in the plane 15. The mould cavity 6 is rectilinear between the corners 8 on the mould outlet side. An arrow 2 indicates a segment of the circumference lines of the mould cavity 6, and the mould cavity 6 has four circumferential segments with similar cross-sectional enlargements 7. The basic shape of the mould cavity 6, could be hexagonal, rectangular, round, etc. instead of square.

The width 20 of the mould cavity 6 on the inlet side 4 in the region of the largest convexity is 5–15% larger than the width 21 at the strand outlet side 5. The width 20 can be at least 8% larger than the width 22 in the plane 14 at the end of the upstream mold portion 12.

The height 10 of the convexity 9 steadily decreases in the direction of travel of the strand 11. The conicity along a line 24 at the maximum height 10 may be 8–35%/m.

The upstream mould portion 12 in this example is 400 mm long or approximately 40% of the mould length, which measures approximately 1000 mm.

As the strand travels through the mold 3, the convexities 9 are deformed. 40 represents diagrammatically a computer, to which the data 41–45 are fed, and where 41 represents the steel analysis, 42 the superheating temperature, 43 the casting temperature in the intermediate vessel, 44 the mould and lubricant parameters, and 45 the continuously measured coefficient of friction between the mould and the strand. For the different operating states, such as casting start, casting under full load, interruption of casting, termination of casting etc., the computer 40 calculates the desired bath level. The bath level determines the degree or amount of deformation of the convexities 9. By means of the stopper or slide control 47, the computer 40 suitably adjusts the flow of metal into the mould and the strand withdrawal speed 48 in order to bring the bath level to the desired height inside the mould.

Figure 3:
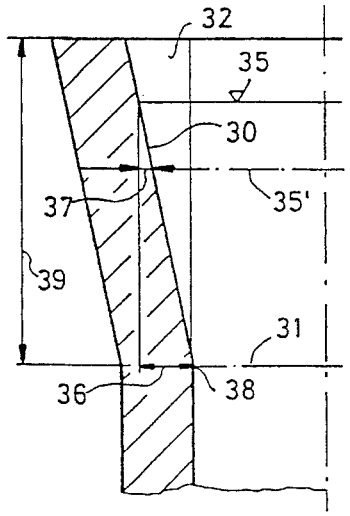
FIG. 3 is a vertical section through a mould wall.

FIG. 3 shows how the amount of deformation is measured. A convexity 32 having a centre line 30 ends in the plane 31. In the direction of travel of the strand, the convexity is rectilinear but could also be defined by a degressive or S-shaped curve, etc.

If the bath level is at the height 35 illustrated, the amount of deformation of the convexity is represented by the length of the arrow 36. If the bath level drops to the height 35' shown with a dot-dash line, the deformation of the convexity is reduced by an amount which is represented by the length 37. If the amount of deformation is to be zero, the bath level is lowered to or below the end point 38 of the upstream mould portion 39.

According to a variation, the process according to the invention is distinguished by the following features. When starting a new strand or sequence, the mould parameters 44 and the casting metal parameters 41–43 are fed into the computer. The computer retrieves from the memory the optimised coefficients of friction for these parameters at different casting speeds as well as the desired bath levels for start up, operation under full load, operation under reduced load and termination of casting. During casting, the superheating and casting temperatures of the casting metal are fed into the computer as correction factors for each measurement. The measured coefficients of friction 45 are constantly compared with the optimised coefficients of friction. In the case of deviations, the amount of deformation of the convexity, i.e. the degree of working of the bulges (at 7) formed in the continuously cast strand 11 by the mould convexities 9, is increased or decreased by raising or lowering the bath level within the upstream mould portion. In this example, the coefficient of friction of the strand in the mould is given greater weight than other casting parameters. Instead of the coefficient of friction, the strand withdrawal force can be selected.

The moulds used for this process are described in detail and illustrated in the drawings in U.S. Pat. No. 5,360,053. The disclosure of the patent is incorporated herein by reference.

Figure 4:
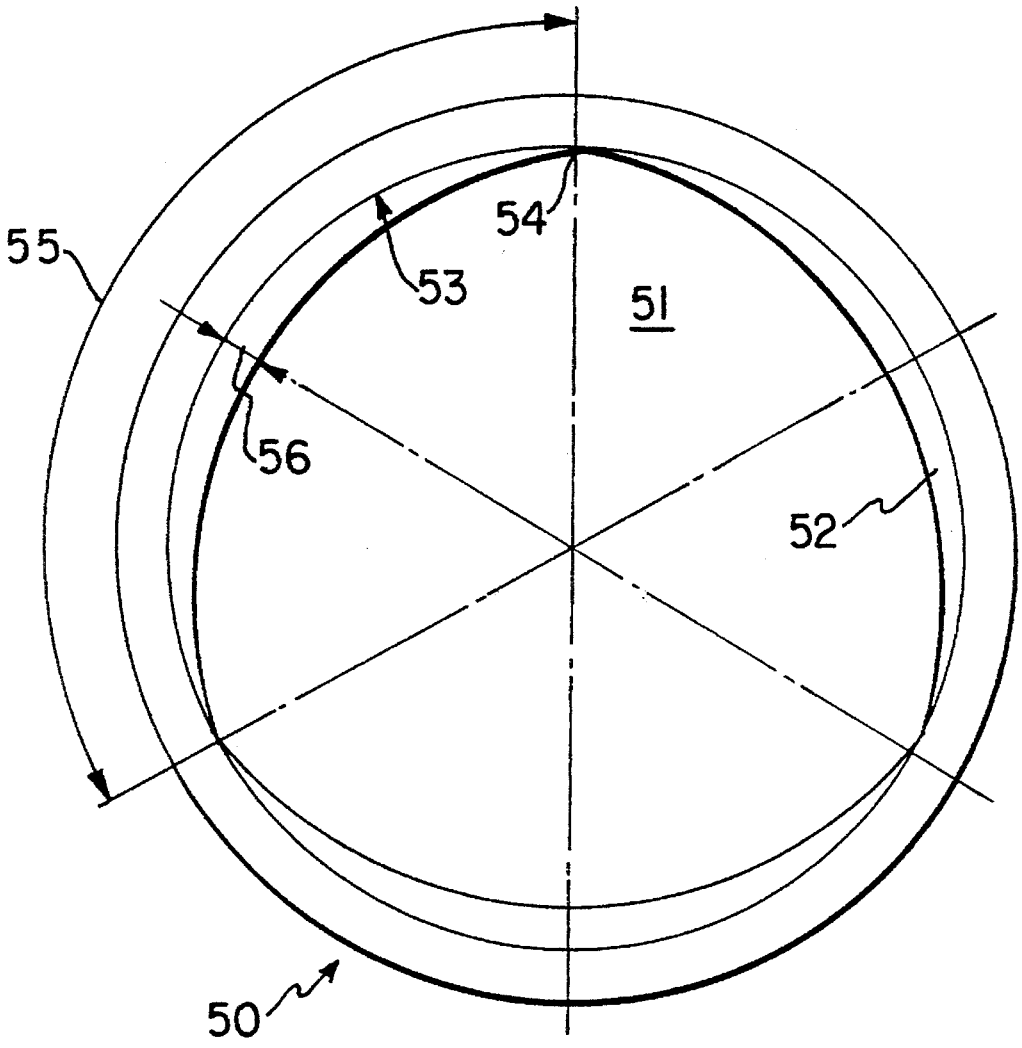
FIG. 4 is a plan view of another embodiment of a tubular mould.

FIG. 4 shows a mould 50 for continuously casting circular strand cross-sections. The mould 50 has a mould cavity 51 whose inlet side is provided with cross-sectional enlargements in the form of convexities or bulges 52. The convexities 52 have a height 56 which represents the degree of convexity, and the height 56 decreases steadily in the direction of travel of the strand over an upstream portion of the mould cavity 51. The mould cavity 51 further has a downstream portion of circular cross-section.

An arrow 53 indicates the inlet side of the mould wall and a circumference line 54 shows the mould cavity cross section in a plane corresponding to the plane 14 of FIG. 1. The mould cavity 51 is circular on the mould outlet side. An arrow 55 indicates a segment of the circumference of the mould cavity 51, and the mould cavity 51 has three circumferential segments 55 with similar cross-sectional enlargements.

We claim:

1. A continuous casting method, comprising the steps of admitting molten metal into a casting passage to establish a bath of said molten metal in said passage, wherein a cross-section of an inlet is larger than that of an outlet, said bath having a variable level; cooling said molten metal in said passage, the cooling step including at least partially solidifying said molten metal to form a continuously cast strand having a plurality of bulges which are distributed substantially uniformly circumferentially of said strand; conveying said strand through said passage; deforming said bulges in said passage by a variable amount during the conveying step; and regulating said amount as a function of at least one of a set of casting parameters including the composition of said molten metal, the speed at which said strand is conveyed through said passage, the superheat of said molten metal, the coefficient of friction of said strand in said passage, and the force with which said strand is conveyed through said passage, the regulating step comprising adjusting said level.

2. The method of claim 1, wherein said molten metal comprises molten steel.

3. The method of claim 1, wherein said strand has a generally polygonal cross section with a plurality of corners and the solidifying step comprises forming a bulge between each pair of neighboring corners.

4. The method of claim 1, wherein said strand has a generally circular cross section and the solidifying step comprises forming at least three bulges circumferentially of said strand.

5. The method of claim 1, further comprising the step of expressing said amount as the number of mm by which said bulges are deformed.

6. The method of claim 1, wherein the said amount is regulated as a function of the composition of said molten metal and the speed at which said strand is conveyed through said passage.

7. The method of claim 1, wherein the said amount is regulated as a function of at least one of the superheat of said molten metal and the speed at which said strand is conveyed through said passage.

8. The method of claim 1, wherein said amount is a function of the speed at which said strand is conveyed through said passage.

9. The method of claim 1, wherein said amount is regulated as a function of the coefficient of friction of said strand in said passage.

10. The method of claim 1, wherein the conveying step comprises withdrawing said strand from said passage with a variable force, and the regulating step comprises varying said amount so as to optimize said force.

11. The method of claim 1, wherein the deforming step comprises reducing the cross section of said strand by about 4 percent to about 15 percent.

12. The method of claim 10, wherein deforming step comprises reducing the cross section of said strand by about 6 percent to about 10 percent.

13. The method of claim 1, further comprising the step of lubricating said passage; and wherein said passage is tapered and is provided with a plurality of bulges corresponding to the bulges in said strand, said set additionally including the taper of said passage, the lengths of the bulges in said passage, the type of lubricant used for the lubricating step, the cross section of said strand and the temperature of said molten metal, and the regulating step comprising comparing an instantaneous value representative of said one parameter with a reference value, and adjusting said level in dependence upon the difference between said instantaneous value and said reference value.

14. The method of claim 1, wherein the cooling step is performed over a predetermined length of said passage, said predetermined length being a function of at least one parameter of said set and being between about 500 mm and about 1000 mm.

15. The method of claim 1, wherein said passage has a predetermined length and substantially all of the deforming step is completed within about 60 percent of said predetermined length.

16. The method of claim 1, wherein said set additionally includes the heat flux in said passage and said amount is regulated as a function of said heat flux.

* * * * *